United States Patent [19]

Wankel

[11] Patent Number: 4,626,182

[45] Date of Patent: Dec. 2, 1986

[54] EXTERNAL SHAFT ROTARY PISTON MACHINE

[75] Inventor: Felix Wankel, Lindau, Fed. Rep. of Germany

[73] Assignees: Felix Wankel, Lindau, Fed. Rep. of Germany; Aisin Seiki Co., Ltd., Kariya, Japan

[21] Appl. No.: 658,482

[22] Filed: Oct. 9, 1984

[30] Foreign Application Priority Data

Oct. 10, 1983 [CH] Switzerland ..... 5516/83

[51] Int. Cl.[4] ..... F01C 1/24

[52] U.S. Cl. ..... 418/191

[58] Field of Search ..... 418/191, 192, 113, 154, 418/155

[56] References Cited

U.S. PATENT DOCUMENTS

| | | | |
|---|---|---|---|
| 417,762 | 12/1889 | Weston | 418/191 |
| 426,553 | 4/1890 | Weston | 418/191 |
| 709,597 | 9/1902 | Frank | 418/192 |
| 866,693 | 9/1907 | Southern & Griest | 418/191 |
| 1,319,456 | 10/1919 | Bingham | 418/191 |
| 1,365,245 | 1/1921 | Hultgreen | 418/113 |
| 1,418,910 | 6/1922 | Funk | 418/191 |
| 3,205,838 | 9/1965 | Frobeen | 418/192 |
| 4,296,936 | 10/1981 | Wankel | 418/191 |

FOREIGN PATENT DOCUMENTS 63240 10/1982 European Pat. Off. ..... 418/191

*Primary Examiner*—Leonard E. Smith
*Assistant Examiner*—Jane E. Obee
*Attorney, Agent, or Firm*—Toren, McGeady, Stanger, Goldberg & Kiel

[57] ABSTRACT

An external shaft rotary piston machine wherein pistons of a piston rotor run in engagement with a cavity of a circular cylindrical sealing rotor during a particular relative rotational position of the rotors, the cavity being substantially larger than necessary for passage of the pistons in order to avoid flow losses due to seal wedging flow and compression. In order to avoid overflow from the high pressure side to the low pressure side of the machine through the sealing rotor while the pistons move in the sealing rotor through the space defined by the cavity, a sealing effect is created by a leading edge and a trailing edge portion of the opening of the cavity of the sealing rotor moving along a leading and a trailing side surface of the pistons. This is effected kinematically due to the fact that the trailing edge of the cavity opening is displaced radially inwardly and that an edge portion extends from the trailing edge convexly relative to the peripheral surface of the sealing rotor.

9 Claims, 8 Drawing Figures

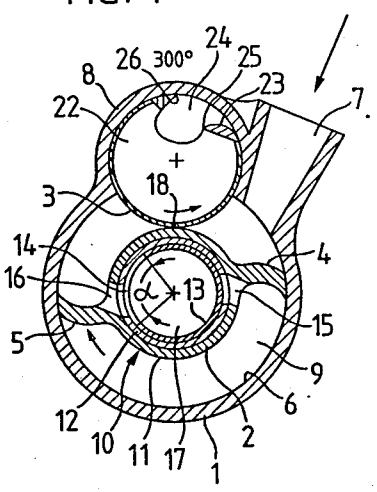
FIG. 1
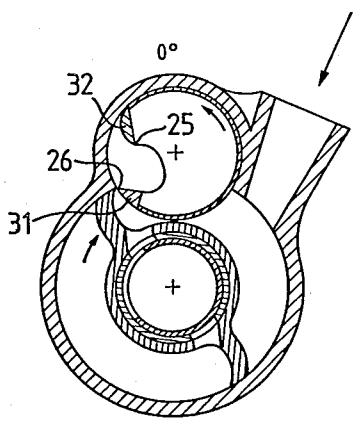
FIG. 2
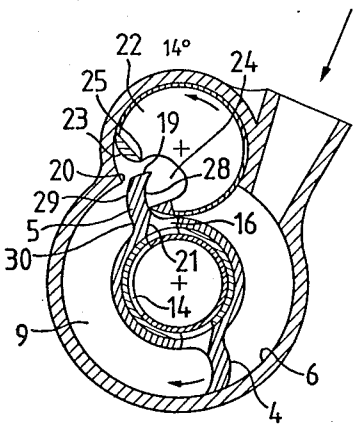
FIG. 3
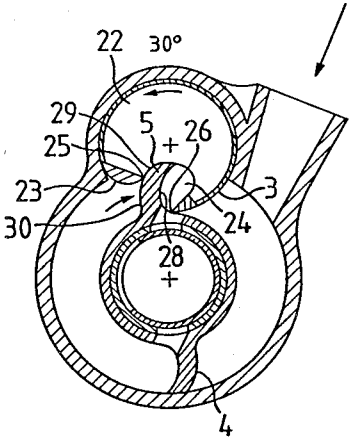
FIG. 4
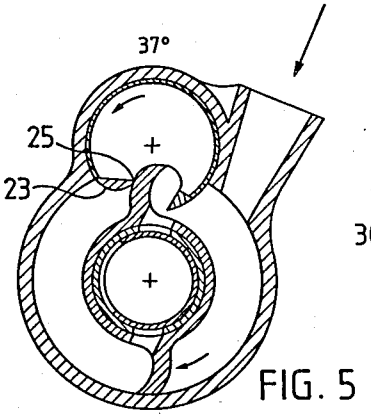
FIG. 5
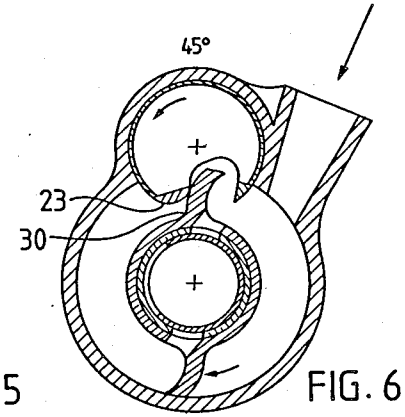
FIG. 6
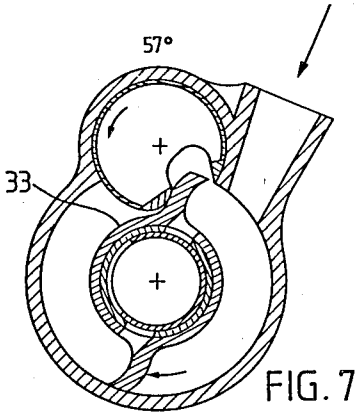
FIG. 7
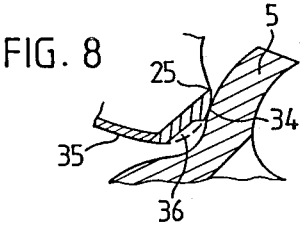
FIG. 8
FIG. 9

EXTERNAL SHAFT ROTARY PISTON MACHINE

The present invention relates generally to an external shaft rotary piston machine and more specifically to a machine wherein a piston rotor and a sealing rotor rotate relative to each other within a common housing, with surface portions of said rotors being brought into mutual sealing engagement with each other during operation of said machine. A rotary piston machine of this kind is known from European Patent Publication No. 63 240, wherein there is described a machine which comprises a cavity provided in its sealing rotor which is substantially larger than that required for a piston of the piston rotor to enter such cavity. This measure offers the advantage that no seal wedge flow of compressed fluid occurs upon the entrance of the piston into the cavity, which would lead to an energy loss.

The enlarged cavity in the sealing rotor may, however, result in the fact that some part, albeit small, of the compressed gas will get back to the low pressure side of the machine as the piston moves through the cavity. In the embodiment depicted in FIGS. 20*a* to 20*e* of European Patent Publication No. 63 240, therefore, the peripheral surface of the piston rolls off onto a central part of the sealing rotor in order to form a sealing against such overflow. The provision of this central part, however, leads to a comparatively high constructional expenditure, and, furthermore, the movement of the piston towards this central part results in local seal wedging flow or compressions which, although small, involve energy losses and generate noise.

Accordingly, the present invention is intended to provide a machine, wherein movement of the piston through a cavity of the sealing rotor may occur in a manner to substantially avoid the occurrence of any squeezed flow and noise generation without the cavity forming a detrimental space, i.e., without allowing an undesired overflow from the high pressure side to the low pressure side of the machine, the machine thereby yielding a high efficiency at a low noise level.

Thus, the invention is directed to providing, with respect to an external shaft rotary piston machine incorporating a piston rotor and a sealing rotor, a construction, wherein the piston may remain in permanent sealing contact with edge portions of the cavity opening during movement of the piston through the cavity in the sealing rotor, so as almost completely to avoid the occurrence of a detrimental space through which the gas might pass from the pressure side to the suction side.

SUMMARY OF THE INVENTION

Briefly, the present invention may be described as an external shaft rotary piston machine comprising: a piston rotor having a shaft with an outer periphery which carries at least one piston, said at least one piston having a concave surface and a radially outer convex surface part; a sealing rotor having a circular cylindrical peripheral surface, said sealing rotor being structured to define an enclosed cavity comprising a receiving opening having a leading and a trailing boundary edge adapted to receive therein said piston of said piston rotor, said cavity being larger than kinematically necessary for movement of said piston through said cavity by an additional volume adjacent to said leading and trailing boundary edges so as to avoid the occurrence of a squeezed flow of compressed fluid; and a common housing enclosing both said sealing and piston rotors; said sealing and piston rotors being structured so that a sealing point is formed between said circular peripheral surface of said sealing rotor and said periphery of said piston rotor shaft; said piston being so shaped that one of said boundary edges of said receiving opening moves in sealed engagement along said concave surface of said piston, with the other of said boundary edges being displaced radially inwardly from said peripheral surface of said sealing rotor, said other boundary edge moving in sealing engagement along said radially outer convex surface of said piston.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DESCRIPTION OF THE DRAWINGS

In the drawings:

FIGS. 1 to 7 show a plurality of successive rotational positions of a rotary piston machine in the form of a supercharger, in cross-section perpendicular to the axis of rotation;

FIG. 8 is a sectional view showing, on a larger scale, the contact region between the trailing edge portion of the sealing rotor and a piston in a further embodiment; and FIG. 9 is a sectional view corresponding to FIG. 8 showing a third embodiment of the present invention.

DETAILED DESCRIPTION OF THE PREFERRED EMBODIMENTS

Referring now to the drawings, and particularly to FIGS. 1–7, wherein the same machine is shown in successive rotational positions, and wherein, similar reference numerals are used to identify like parts, a machine, in accordance with the invention, is shown as comprising a housing 1 which encloses a piston rotor 2 and a sealing rotor 3 which are supported in bearings at the two axial ends of the housing in the usual way (not shown) and which are in driving connection with each other with relative rotational speeds of 1:2 by means of two gear wheels. The rotors 2, 3 rotate in opposite directions as shown by the arrows. The gas to be compressed is sucked in through the inlet socket 7 as a result of the motion of the pistons 4, 5 along the inner wall 6 of the housing.

The inlet socket 7 is arranged directly adjacent to the housing portion 8 which sealingly encloses the sealing rotor 3, and opens in a substantially tangential direction into the circular cylindrical working space 9 swept by the pistons 4, 5. This working space is limited internally by a hollow shaft 10 of the piston rotor 2, the pistons 4, 5 being secured to the peripheral surface thereof. As illustrated, the pistons are secured to an outer hollow cylindrical rotor portion 11 rigidly surrounding an inner hollow shaft 12.

The hollow shaft 10 encloses a stationary hollow cylindrical control sleeve 13 comprising an aperture 14 provided in its wall and extending over an angular arc. Further apertures 15, 16 situated in front of the pistons 4, 5 with respect to the sense of rotation are provided in the hollow shaft 12. Upon rotation of the rotor 2, the apertures 15, 16 of the hollow shaft 10 pass over the aperture 14 and the compressed gas in the annular space 9 may flow inwardly into the outlet channel 17 which is enclosed by the sleeve 13.

The outlet aperture 14 in the wall of the sleeve 13 as well as the inlet channel 7 are arranged to be as close as possible to the sealing rotor 3 in order to reach a compression ratio as high as possible upon each revolution of the pistons 4, 5.

By rotation of the control sleeve 13, the angular position of the outlet aperture 14 may be altered in order to control the delivery of the machine. For optimal delivery, the aperture 14 is closed, as shown in FIG. 3, shortly after the outer peripheral surface 19 of the piston 5 or 4 moving along on the inner wall 6 of the housing has left the edge 20 of the annular working space 9. In order to enable the apertures 14 to be closed as late as possible, the trailing boundary surface 21 of the aperture 16 in the hollow shaft of the piston rotor is cut back from the piston 5.

As soon as the piston 5 has ceased to be in contact with the inner wall 6 of the housing after leaving the housing edge 20, the pistons 4, 5 begin to compress a certain amount of gas into the cavity 22 of the sealing rotor 3, until the trailing edge portion 23 of the receiving opening 24 of the sealing rotor has come into sealing proximity or contact with the piston 5. The gas compressed into the cavity 22 of the sealing rotor during this short angle of rotation of the piston rotor gets back to the suction side of the machine and, thus, reduces the efficiency of the machine.

In accordance with the provisions of the present invention, this angle of rotation is reduced to a minimum, as the trailing edge portion 23 of the opening 24 comes into sealing proximity with the piston 5 substantially earlier than is possible with known principles of construction. The drawing shows that the trailing edge 25 of the receiving opening 24 of the sealing rotor is displaced radially inwardly, while the leading edge 26 of the receiving opening 24 is arranged to be at the outer periphery of the sealing rotor.

The edge portion of the receiving opening 24 runs out in a curve from this inwardly displaced trailing edge 25 of the sealing rotor and merges continuously into the peripheral surface of the sealing rotor. Due to the requirement that the leading or first edge 26 at the periphery of the sealing rotor should move along on the leading piston surface 28 and the trailing, radially inwardly displaced boundary edge 25 of the receiving opening 24 should move along on a radially outer part 29 of the trailing piston surface, while the curved edge portion 23 of the receiving opening 24 should roll off on a radially inner part 30 of the trailing piston surface, the cross-sectional shape of the pistons 5, 4 is geometrically determined. Consequently, the cross-sectional shape of the pistons 5, 4 is designed to be approximately S-shaped.

The trailing or second edge 25 of the sealing rotor glides along the convex surface part 29 as shown in FIGS. 4 and 5, and consecutively the curved edge portion 23 rolls off on the concave surface part of the trailing piston surface, as shown in FIGS. 6 and 7. In this manner, the width of the receiving opening 24 of the sealing rotor is reduced to the minimum for a given thickness of the piston, so that the machine exhibits minimal losses by reason of leakage from the high pressure side to the low pressure side. The breadth of the pistons 4, 5, measured in the peripheral direction, determines the size of the receiving opening 24 in the sealing rotor. This breadth is selected to a predetermined value so as to maintain an adequate sealing between the peripheral surface of the pistons and the inner surface 6 of the housing 1. For an improved sealing, it is possible to provide sealing strips secured to the periphery of the pistons, preferably based on the principle disclosed in German Patent Publication No. 30 05 694.

As a result of the present invention, it is possible without any disadvantage to enlarge the cavity 22 of the sealing rotor to such an extent that the sealing rotor may be constituted by a thin-walled cylindrical shell. In order to mechanically balance the sealing rotor rotating with higher speed, with respect to the piston rotor's doubled rotational speed, the portion of the sealing rotor adjacent the leading edge 26 of the opening and the trailing, curved edge portion is solidly constructed and may comprise, e.g., separate strips 31, 32 secured to the wall of the sealing rotor. Such a separate construction of strips thus bordering on the receiving opening 24 facilitates the precise finishing of the outer surface contours of the edges 25 and 26 as well as of the convexly curved portion 23 adjacent the edge 25. The edges 25, 26 may be relatively sharp, as shown in FIGS. 1 to 8, but nevertheless, they may comprise a rounded cross-section as well.

It is advisable to provide a slight rounding of the edges, as a sharp edge could lead to sealing losses due to wear. Because the sealing rotor has the shape of a thin-walled cylindrical shell, and additionally due to the provision of the mentioned strips forming the edges or walls of the opening, the sealing rotor is substantially easier to manufacture in comparison to known constructions.

FIGS. 8 and 9 show two embodiments of the invention in which measures have been taken to avoid any squeezed flow which might occur, even though to a limited extent, if the convex edge portion 23, according to the embodiment of FIGS. 1 to 7, rolls off onto the shaft of the piston rotor up to the peripheral surface 33 thereof. In the embodiment according to FIG. 8, the convexly curved portion 34 adjacent to the edge 25, which rolls off onto the piston 5, is substantially reduced for this purpose, due to the fact that a recess 36 is provided between this portion 34 and the peripheral surface 35 of the sealing rotor. It will be understood that a plurality of smaller recesses, one behind another, instead of one single recess 36, could also be provided.

The embodiment according to FIG. 9 shows a recess 37 in the portion of the piston joining in the radially inward direction of the outwardly convex surface part 29 of the piston 5 and merging into the peripheral surface 33 of the shaft of the piston rotor, which likewise reduces the seal wedging flow leading to losses. It will be understood that such recess 37 may also be replaced by several smaller recesses. Furthermore, in both embodiments, the recesses 36, 37 can also be provided in greater numbers adjacent one another in the axial direction of the rotor, so that they are separated from one another by web portions (not shown). These web portions counteract any reduction in cross-section, e.g., in the region of the root of the piston 5.

Thus, it will be seen that, with the invention, the pistons 4, 5 of the piston rotor 2 run into engagement with a cavity opening 24 of a circular cylindrical sealing rotor 3 during a particular rotational position. The sealing rotor 3 encloses the cavity 22 which is substantially larger than would be necessary for the passage of the pistons 4, 5 in order to avoid flow losses due to squeezed flow and compressions. In order to avoid an over-flow from the high pressure side to the low pressure side through the sealing rotor while the pistons move in the sealing rotor through the free space, a sealing is effected inasmuch as the leading edge and the trailing edge portion 23 of the cavity opening 24 of the sealing rotor sealingly move along on a leading and a trailing side surface 28, 29 of the pistons. This is effected kinematically due to the fact that the trailing edge is displaced radially inwardly and that an edge portion runs out from this edge convexly to the peripheral surface of the sealing rotor.

While specific embodiments of the invention have been shown and described in detail to illustrate the application of the inventive principles, it will be understood that the invention may be embodied otherwise without departing from such principles.

What is claimed is:

1. An external shaft rotary piston machine comprising:

a piston rotor having a shaft with an outer periphery which carries at least one piston, said at least one piston having a generally radially extending curved configuration with a concave surface on one side thereof and a convex surface on an opposite side thereof;

a sealing rotor having a circular cylindrical peripheral surface, said sealing rotor being structured to define an enclosed cavity comprising a receiving opening having a leading and a trailing boundary edge adapted to receive therein said piston of said piston rotor, said cavity being formed to consist essentially of a volume portion kinematically necessary for movement of said piston through said cavity and of an additional volume portion in excess of said kinematically necessary portion adjacent to said leading and trailing boundary edges, said additional volume and said kinematically necessary volume portion being contiguous and forming the entire volume of said cavity, said cavity thereby being larger than kinematically necessary for movement of said piston through said cavity by said additional volume portion so as to avoid the occurrence of compressed effects upon fluid squeezed between surfaces moving rapidly toward each other; and a common housing enclosing both said sealing rotor and said piston rotor;

said sealing rotor and said piston rotor being structured so that a sealing point is formed between said circular peripheral surface of said sealing rotor and said periphery of said piston rotor shaft;

said piston being so shaped that one of said boundary edges of said receiving opening moves in sealed engagement along said concave surface of said piston with the other of said boundary edges being displaced radially inwardly from said peripheral surface of said sealing rotor and being formed between said volume portion kinematically necessary for movement of said piston through said cavity and said additional volume portion, said other boundary edge moving in sealing engagement along said convex surface of said piston.

2. A machine according to claim 1 wherein said sealing rotor is in the shape of a circular cylindrical shell, said receiving opening corresponding to an opening in said shell.

3. A machine according to claim 8 wherein said boundary edges of said sealing rotor extend parallel to the axis of rotation thereof, said machine further comprising strips defining said edge portions secured to the wall of said shell.

4. A machine according to claim 1 wherein said sealing rotor is formed with an edge portion which is convexly curved taken relative to the axis of rotation thereof which extends from said other of said boundary edges in a direction toward said peripheral surface of said sealing rotor, said convexly curved edge portion rolling off on a surface portion of said part during operation of said machine.

5. A machine according to claim 4 wherein said convexly curved edge portion merges continuously into said peripheral surface of said sealing rotor with a varying radius of curvature and rolls off on said piston up to the peripheral surface of said shaft of said piston rotor during operation of said machine.

6. An external shaft rotary piston machine comprising:

a piston rotor having a shaft with an outer periphery which carries at least one piston, said at least one piston having a concave surface and a radially outer convex surface part;

a sealing rotor having a circular cylindrical peripheral surface, said sealing rotor being structured to define an enclosed cavity comprising a receiving opening having a leading and a trailing boundary edge adapted to receive therein said piston of said piston rotor, said cavity being formed to consist essentially of a portion kinematically necessary for movement of said piston through said cavity and of an additional volume adjacent to said leading and trailing boundary edges, said cavity thereby being larger than kinematically necessary for movement of said piston through said cavity by said additional volume so as to avoid the occurrence of compressive effects upon fluid squeezed between surfaces moving rapidly toward each other;

a common housing enclosing both said sealing rotor and said piston rotor;

said sealing rotor and said piston rotor being structured so that a sealing point is formed between said circular peripheral surface of said sealing rotor and aaid periphery of said piston rotor shaft;

said piston being so shaped that one of said boundary edges of said receiving opening moves in sealed engagement along said concave surface of said piston with the other of said boundary edges being displaced radially inwardly from said peripheral surface of said sealing rotor and being formed between said portion kinematically necessary for movement of said piston through said cavity and said additional volume, said other boundary edge moving in sealing engagement along said radially outer convex surface part of said piston;

said sealing rotor being formed with an edge portion which is convexly curved taken relative to the axis of rotation thereof which extends from said other of said boundary edges in a direction toward said peripheral surface of said sealing rotor, said convexly curved edge portion rolling off on a surface part of said piston during operation of said machine; and at least one recess being provided between said convexly curved edge portion and said circular cylindrical peripheral surface of said sealing rotor operative to avoid said compressive effect.

7. A machine according to claim 6 wherein said convexly curved edge portion merges continuously into said peripheral surface of said sealing rotor with at least one recess being provided in that portion of said piston which joins radially inwardly on said outer convex surface part of said piston.

8. A machine according to claim 6, wherein said boundary edges of said sealing rotor extend parallel to the axis of rotation thereof, said machine further comprising strips defining said edge portions secured to the wall of said shell.

9. An external shaft rotary piston machine comprising:

a piston rotor having a shaft with an outer periphery which carries at least one piston, said at least one pison having a concave surface and a radially outer convex surface part;

a sealing rotor having a circular cylindrical peripheral surface, said sealing rotor being structured to define an enclosed cavity comprising a receiving opening having a leading and a trailing boundary edge adapted to receive therein said piston of said piston rotor, said cavity being formed to consist essentially of a portion kinematically necessary for movement of said piston through said cavity and of an additional volume adjacent to said leading and trailing boundary edges, said cavity thereby being larger than kinematically necessary for movement of said piston through said cavity by said additional volume so as to avoid the occurrence of compressive effects upon fluid squeezed between surfaces moving rapidly toward each other; and a common housing enclosing both said sealing rotor and said piston rotor;

said sealing rotor and said piston rotor being structured so that a sealing point is formed between said circular peripheral surface of said sealing rotor and said periphery of said piston rotor shaft;

said piston being so shaped that one of said boundary edges of said receiving opening moves in sealed engagement along said concave surface of said piston with the other of said boundary edges being displaced radially inwardly from said peripheral surface of said sealing rotor and being formed between said portion kinematically necessary for movement of said piston through said cavity and said additional volume, said other boundary edge moving in sealing engagement along said radially outer convex surface part of said piston;

said sealing rotor being formed with an edge portion which is convexly curved taken relative to the axis of rotation thereof which extends from said other of said boundary edges in a direction toward said peripheral surface of said sealing rotor, said convexly curved edge portion rolling off on a surface part of said piston during operation of said machine;

said convexly curved edge portion merging continuously into said peripheral surface of aaid sealing rotor with at least one recess being provided in that portion of said piston which joins radially inwardly on said outer convex surface part of said piston.

* * * * *